US005267932A

United States Patent [19]

Grant

[11] Patent Number: 5,267,932

[45] Date of Patent: Dec. 7, 1993

[54] TOP ROLL FOR DRAFTING TEXTILE FIBERS

[75] Inventor: Kenneth R. Grant, Piedmont, S.C.

[73] Assignee: Progressive Equipment, Inc., Simpsonville, S.C.

[21] Appl. No.: 983,898

[22] Filed: Dec. 1, 1992

[51] Int. Cl.[5] ..... B21B 13/02

[52] U.S. Cl. ..... 492/20; 492/57; 19/265; 19/295

[58] Field of Search ..... 492/16, 39, 47, 20, 492/57; 19/258, 265, 295

[56] References Cited

U.S. PATENT DOCUMENTS

| | | | |
|---|---|---|---|
| 628,521 | 7/1899 | Campbell | 19/295 |
| 2,730,771 | 1/1956 | Beck et al. | 19/295 |
| 2,806,258 | 9/1957 | Wasley | 19/295 |
| 2,885,247 | 5/1959 | Schlams | 492/16 X |
| 2,938,242 | 5/1960 | Schilknecht | 19/295 |
| 2,979,784 | 4/1961 | Cotchett | 19/295 |
| 3,052,953 | 9/1962 | Swanson | 19/295 |
| 3,613,199 | 10/1971 | Duquette | 492/16 X |
| 4,010,527 | 3/1977 | Swanson | 19/295 |
| 4,183,127 | 1/1980 | Suzuki | 19/295 |

FOREIGN PATENT DOCUMENTS

| | | | |
|---|---|---|---|
| 2061431 | 6/1972 | Fed. Rep. of Germany | 492/16 |
| 2061434 | 6/1972 | Fed. Rep. of Germany | 492/16 |
| 7023330 | 6/1972 | Japan | 492/16 |

*Primary Examiner*—Timothy V. Eley
*Attorney, Agent, or Firm*—Ralph Bailey

[57] ABSTRACT

A top roll for use in drafting textile fibers includes a disposable cartridge C at each end each containing sealed ball bearings and a spacer between the bearings so as to be maintained in an assembled relation and positioned upon reduced end portions of a top roll shaft by the end screw D.

2 Claims, 1 Drawing Sheet

TOP ROLL FOR DRAFTING TEXTILE FIBERS

BACKGROUND OF THE INVENTION

This invention relates to top rolls for drafting textile fibers having disposable end cartridges for carrying the cots.

It is the present practice on top rolls used in drafting textile fibers utilizing spaced cots to throw away the entire top roll after the bearings have reached the end of their useful life. Although disposable cartridges containing bearings have been utilized, such have been constructed utilizing single needle bearings which have a limited life due to inherent difficulties and to the fact that they are of the single bearing type. Such bearings which have been used heretofore have required greasing and regular maintenance.

The following U.S. Patents illustrate the state of the art: Re.24,687; U.S. Pat. Nos. 2,812,554; 2,704,393; 2,905,978; 2,948,024; 2,965,934; 3,003,196; 3,052,953; 3,228,088; 3,395,427; 3,613,199; and 4,010,527.

Accordingly, it is an important object of this invention to provide a top roll having end cartridges which are disposal and which do not require maintenance or greasing.

Another important object of the invention is to provide a top roll for disposable end cartridges secured by an end bearing, each of which contains a pair of ball bearings, provided with a spacer, said bearings being sealed so as not to require greasing and positioned in spaced relation for long life.

Still another important object of the invention is to provide a replaceable top roll used in drafting textile fibers which have bearings capable of long life with minimal maintenance requirements and which utilize disposable cartridges making it possible to replace a portion of the top roll rather than throwing the entire top roll away after the bearings have exceeded their useful life.

SUMMARY OF THE INVENTION

It has been found that a top roll may be provided for use in drafting textile fibers utilizing a disposable cot carrying cartridges at each reduced end of an elongated shaft. Each of the cartridges contains a pair of sealed ball bearings having a spacer therebetween. An end screw entirely within an end cavity in the shell maintains the components within the shells forming the cartridges and positions the cartridges upon the reduced end portions of the shaft. Thus, lubrication is not required and the cartridges may be removed and discarded reducing the costs which would be involved in replacing the entire top roll after the bearings have exceeded their useful life.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 2:
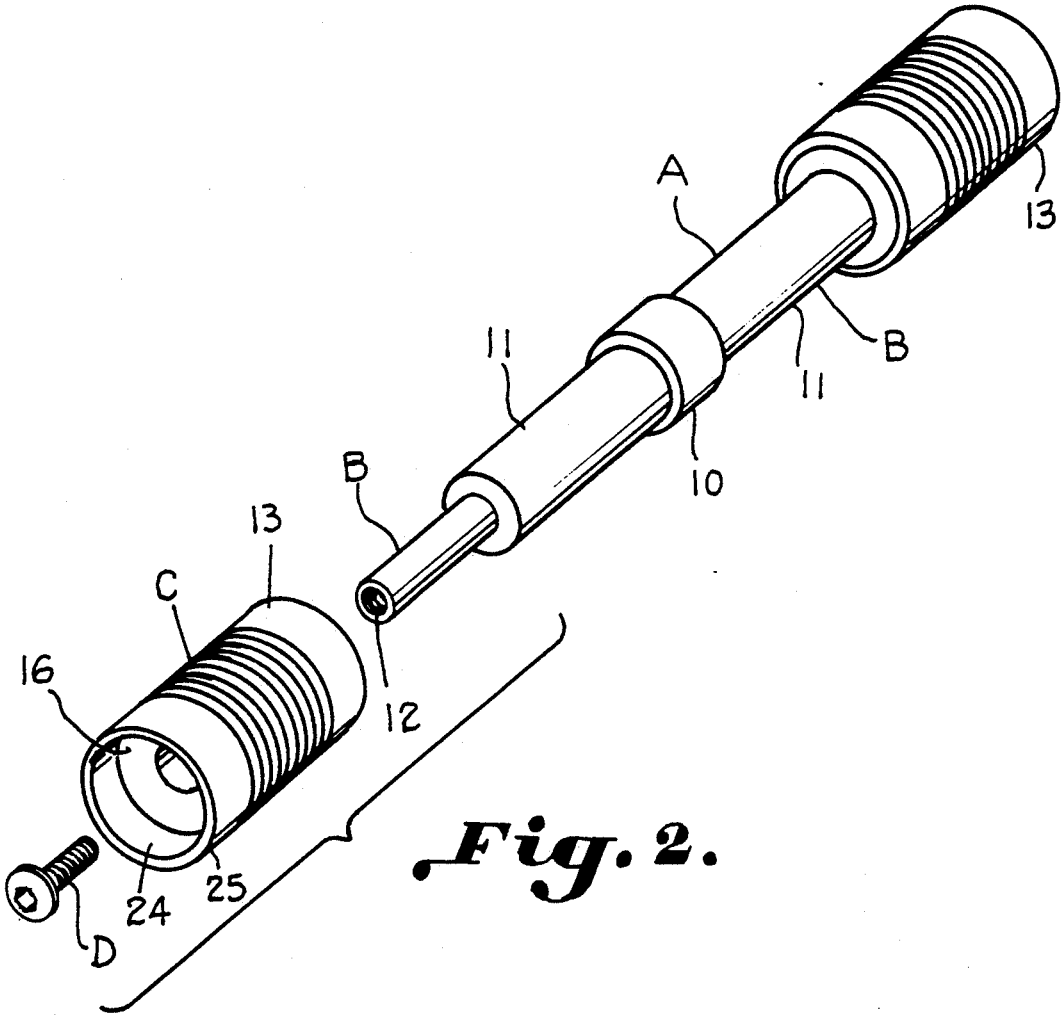
FIG. 2 is a perspective view further illustrating the top roll with a cartridge being installed for being subsequently discarded after the bearings have become excessively worn.
Figure 1:
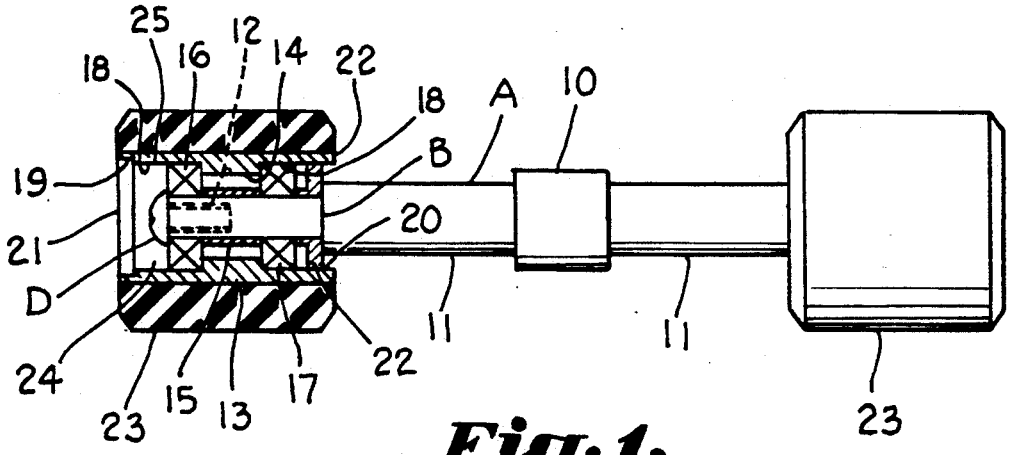
FIG. 1 is a front view, partially in section, illustrating a top roll constructed in accordance with the present invention utilizing a removable and discardable cartridge which requires limited maintenance and no lubrication.

The drawings illustrate a top roll for use in drafting textile fibers utilizing spaced cots. An elongated shaft A has a central mounting for positioning same as on a roll stand in a textile drafting system. Reduced receiving members B are provided on each end of the elongated shaft. A pair of mounting cartridges C carrying the cots are removably secured upon the reduced receiving members. The mounting cartridges C each include an elongated hollow shell. A pair of sealed ball bearings are carried within the shell, and a spacer is provided between the bearings. An end screw D is threadably received axially within each end of the shaft contained entirely within an end recess or cavity in the shell formed by a reduced overhanging portion thereof retaining the sealed bearings and spacer within a shell forming a cartridge and removably positioning the shell and the cartridge formed thereby upon the reduced receiving members on the shaft.

Thus, the cartridges may not require lubrication or maintenance so as to be readily removed, discarded and replaced. Each end of the shells have a reduced portion respectively carrying a lint shield on an inner end and an end cover extending over the screw on the outer end.

The elongated shaft A has a central mounting 10 positionable upon a roll stand and intermediate shaft members 11 extending on each side thereof terminating in end reduced end portions B on each end of the elongated shaft. Each of the end portions B have an internally threaded bore 12 at each end for threadably receiving an end screw D for maintaining the respective cartridges C in assembled relation and positioned on the end of the shaft A.

It will be observed that the cartridges C each include an elongated hollow shell 13. Each of the shells 13 have an internal, enlarged annular portion 14 intermediate its ends which is commensurate with the spacer 15 carried between each pair of sealed ball bearings illustrated at 16 and 17 within reduced end portions 18. Further reduced portions at the outer end as at 19 and on the inner end each at 20 accommodate an end cap 21 and a lint shield 22 respectively. It will be observed that an overhang 22 is provided at the other end of the shells to further avoid entry of lint past the lint shield into the bearings.

It will further be observed that the cartridges C may be readily removed for replacing them by removal of the end screws D after removal of the end cap 21. The cartridges together with cots 23 carried thereby are removed for discarding, thus preserving the shaft A for further use. Moreover, the top roll will have extended life although lubrication and maintenance are not required.

It will be observed that the cartridges have outer cavities 24 formed by an outer overhanging portion 25 of the shells. The end caps 21 and the end screws are maintained entirely within these respective cavities.

The removable and replaceable end caps 21 may be constructed of various colors of plastic and color coded so that the sizes and characteristics of the cots may be designated and determined by placing and thereafter looking at the plastic end caps.

While a preferred embodiment of the invention has been described using specific terms, such description is for illustrative purposes only, and it is to be understood that changes and variations may be made without departing from the spirit or scope of the following claims.

What is claimed is:

1. A top roll carried by a roll stand for use in drafting textile fibers utilizing spaced cots comprising:

an elongated shaft having a central mounting for positioning same on a roll stand;

reduced receiving members on each end of said elongated shaft;

disposable mounting cartridges, carrying said cots, removably secured in assembled relation at each end of said shaft upon said reduced receiving members;

said disposable mounting cartridges each including an elongated hollow shell;

a pair of sealed bearings carried within said shell;

a spacer between said bearings; and an end screw threadably received axially entirely within a cavity at each end of said shaft contained within an overhanging portion of said shells retaining said sealed bearings and spacer within each shell installing said cartridges and removably positioning said cartridges for easy removal by removal of said end screw upon said reduced receiving members on said shaft;

whereby said cartridges may not require lubrication or maintenance since they are readily removed, discarded and replaced.

2. The structure set forth in claim 1 wherein each end of respective shells have a reduced portion respectively carrying a lint shield on one end and an end cover extending over said screw on the other end.

* * * * *